US006527501B2

(12) United States Patent
Wolf

(10) Patent No.: US 6,527,501 B2
(45) **Date of Patent: *Mar. 4, 2003**

(54) APPARATUS FOR ACCUMULATING AND TRANSPORTING STACKS OF PAPER SHEETS AND THE LIKE

(75) Inventor: Wolfram Wolf, Bilsen (DE)

(73) Assignee: E.C.H. Will GmbH, Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/428,643

(22) Filed: Oct. 28, 1999

(65) Prior Publication Data

US 2002/0081187 A1 Jun. 27, 2002

(30) Foreign Application Priority Data

Oct. 29, 1998 (DE) ..... 198 49 859

(51) Int. Cl.[7] ..... B65H 31/20

(52) U.S. Cl. ..... 414/789; 271/217; 271/224; 414/790.2; 414/900

(58) Field of Search ..... 271/216, 217, 271/223, 224; 414/789, 789.1, 790.2, 790.6, 794.5, 900

(56) References Cited

U.S. PATENT DOCUMENTS

| | | | | |
|---|---|---|---|---|
| 2,466,544 A | * | 4/1949 | Harred | |
| 3,191,927 A | * | 6/1965 | Hartbauer et al. | 414/789 |
| 3,867,876 A | * | 2/1975 | Van de Gent | 414/789 |
| 4,436,472 A | | 3/1984 | Kunzmann | |
| 4,569,622 A | * | 2/1986 | Buck | 414/789 |
| 5,000,657 A | * | 3/1991 | Gunther, Jr. | 414/789 X |
| 5,178,379 A | * | 1/1993 | Edwards et al. | 414/789 X |
| 5,484,255 A | * | 1/1996 | Lowell | 414/789 |
| 5,980,196 A | * | 11/1999 | Roth | 414/794.5 X |

FOREIGN PATENT DOCUMENTS

| | | | |
|---|---|---|---|
| DE | 1 071 101 | * 12/1959 | 414/789 |
| DE | 25 08 745 | 9/1976 | |
| DE | 30 46 107 | 6/1982 | |
| DE | 3 601 294 A1 | 7/1987 | |
| DE | 196 12 293 | 10/1997 | |
| EP | 0 798 252 A2 | 10/1997 | |
| GB | 2 186 554 B | 8/1987 | |

* cited by examiner

*Primary Examiner*—Janice L. Krizek
(74) *Attorney, Agent, or Firm*—Venable LLP; Robert Kinberg

(57) ABSTRACT

An apparatus for gathering successive sheets of a scalloped stream in an adjustable receptacle has a pivotable first stop in front of and a longitudinally adjustable second stop behind the receptacle. The second stop is shifted, together with the conveyor for the stream, toward or away from the first stop when the length of the sheets forming the stream is changed. The effective width of the receptacle is adjusted when a stream of relatively narrow sheets is followed by a stream of wider sheets or vice versa.

13 Claims, 8 Drawing Sheets

APPARATUS FOR ACCUMULATING AND TRANSPORTING STACKS OF PAPER SHEETS AND THE LIKE

CROSS-REFERENCE TO RELATED CASES

This application claims the priority of German patent application Ser. No. 198 49 859.4 filed Oct. 29, 1998. The disclosure of the German patent application, as well as that of each US and foreign patent and patent application mentioned in the specification of the present application, is incorporated herein by reference.

BACKGROUND OF THE INVENTION

The present invention relates to improvements in apparatus for accumulating successive sheets of short or long series of sheets into piles or stacks of overlapping sheets at a stacking station, and for removing stacks from a sheet-gathering receptacle at the stacking station. More particularly, the invention relates to improvements in apparatus which can automatically remove successive freshly gathered stacks while the sheets continuously arriving at the stacking station gather into fresh or growing stacks of overlapping sheets. Apparatus of such character are known as sheet piling devices, and one thereof is described and shown in U.S. Pat. No. 4,436,472 granted Mar. 13, 1984 to Kunzmann.

The patent to Kunzmann discloses an apparatus wherein several stacking units are placed side-by-side. A drawback of the patented apparatus is that its design imposes limits upon the number of stacks or piles which can be gathered per unit of time with a requisite degree of accuracy. Moreover, the condition of the sheets is likely to be affected if the rate at which the sheets are supplied and stacked exceeds a relatively low threshold value.

Another drawback of conventional apparatus of the above outlined character is that they cannot be rapidly converted for the stacking of sheets having different sizes and/or shapes. This can result in prolonged interruptions of the operation and a considerable reduction of the output.

OBJECTS OF THE INVENTION

An object of the instant invention is to provide an apparatus which constitutes an improvement over and an advantageous further development of apparatus disclosed in the aforementioned U.S. Pat. No. 4,436,472 to Kunzmann.

Another object of the invention is to provide an apparatus which can be rapidly converted to gather larger or smaller, wide or narrower and/or shorter or longer sheets with the same degree of accuracy.

A further object of the present invention is to provide novel and improved means for manipulating one or more abutments for the growing stacks of paper sheets or the like.

An additional object of the invention is to provide a novel and improved method of manipulating successive sheets of a stream or flow of partially overlapping sheets in a stacking machine.

Still another object of the invention is to provide a sheet stacking apparatus which can gather sheets of different thicknesses and/or other characteristics with the same degree of accuracy and predict-ability.

Another object of the invention is to provide a novel and improved method of manipulating scalloped streams of partially overlapping paper sheets or the like preparatory to and during conversion or gathering into stacks or piles.

Still another object of the invention is to provide an apparatus which can be reliably converted for the processing of sheets having different sizes and/or shapes within short intervals of time.

SUMMARY OF THE INVENTION

The invention resides in the provision of an apparatus for gathering successive sheets of a series of sheets (such as paper sheets) into growing stacks which are being gathered in and, when fully grown, are removed from a receptacle at a stacking station. The apparatus comprises means for conveying successive sheets of the series (e.g., successive sheets of a scalloped stream consisting of partially overlapping sheets) in a first direction (e.g., substantially horizontally) into the receptacle at the stacking station to thus accumulate in the receptacle a growing stack of overlying or overlapping sheets, front and rear abutments or stops for the sheets of a stack in the receptacle (the abutments are spaced apart from each other in the first direction and the front abutment is movable relative to the receptacle between operative and inoperative positions), means for withdrawing fully grown stacks from the receptacle in the first direction while the front abutment dwells in the inoperative position, means for transporting withdrawn stacks in a second direction (e.g., substantially horizontlly and substantially at right angles to the first direction) , and means for adjusting the rear abutment in and counter to the first direction. The conveying means can comprise a belt or chain conveyor or another suitable conveyor which can deliver to the receptacle sheets having different lengths, and the rear abutment is adjustable for the purpose and to the extent necessary to conform the spacing of the front and rear abutments from each other to the lengths of sheets being conveyed to the receptacle.

The apparatus can further comprise a platform which can resemble or constitute a rake and serves to separate the sheets. The platform is movable with the conveying means between a plurality of positions, such as forwardly and backwards (as seen in the first direction) and/or up and down. The movements of the platform in and counter to the first direction can take place in synchronism with movements of the withdrawing means (the latter can include gripper or holder means adapted to engage the front end portion of a fully grown stack and to pull the stack from the receptacle while the front abutment is maintained in its inoperative position).

The conveying means is or can be arranged to share the movements of the platform between a plurality of different levels.

In accordance with a presently preferred embodiment, the apparatus further comprises a carriage (such as a slide) for the aforementioned platform and for the conveying means, as well as an elevator which serves to move the carriage between a plurality of different levels. The carriage is movable (preferably relative to the elevator) in and counter to the first direction, and the elevator is movable up and down relative to the receptacle at the stacking station.

The mounting of the platform on the carriage is or can be such that the platform is movable relative to the carriage in and counter to the first direction through distances corresponding to the extent of adjustment of the rear abutment relative to the front abutment.

The forward end of the sheet conveying means is preferably disposed at a predetermined (fixed) distance from the platform.

The receptacle can be provided with an exchangeable bottom wall, and such bottom wall can include an exchangeable substantially strip-shaped holder as well as a plurality of sheet supporting rakes carried by the holder. The holder can further carry lateral stops and guide means for the lateral stops.

The novel features which are considered as characteristic of the invention are set forth in particular in the appended claims. The improved apparatus itself, however, both as to its construction and its mode of operation, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1A:
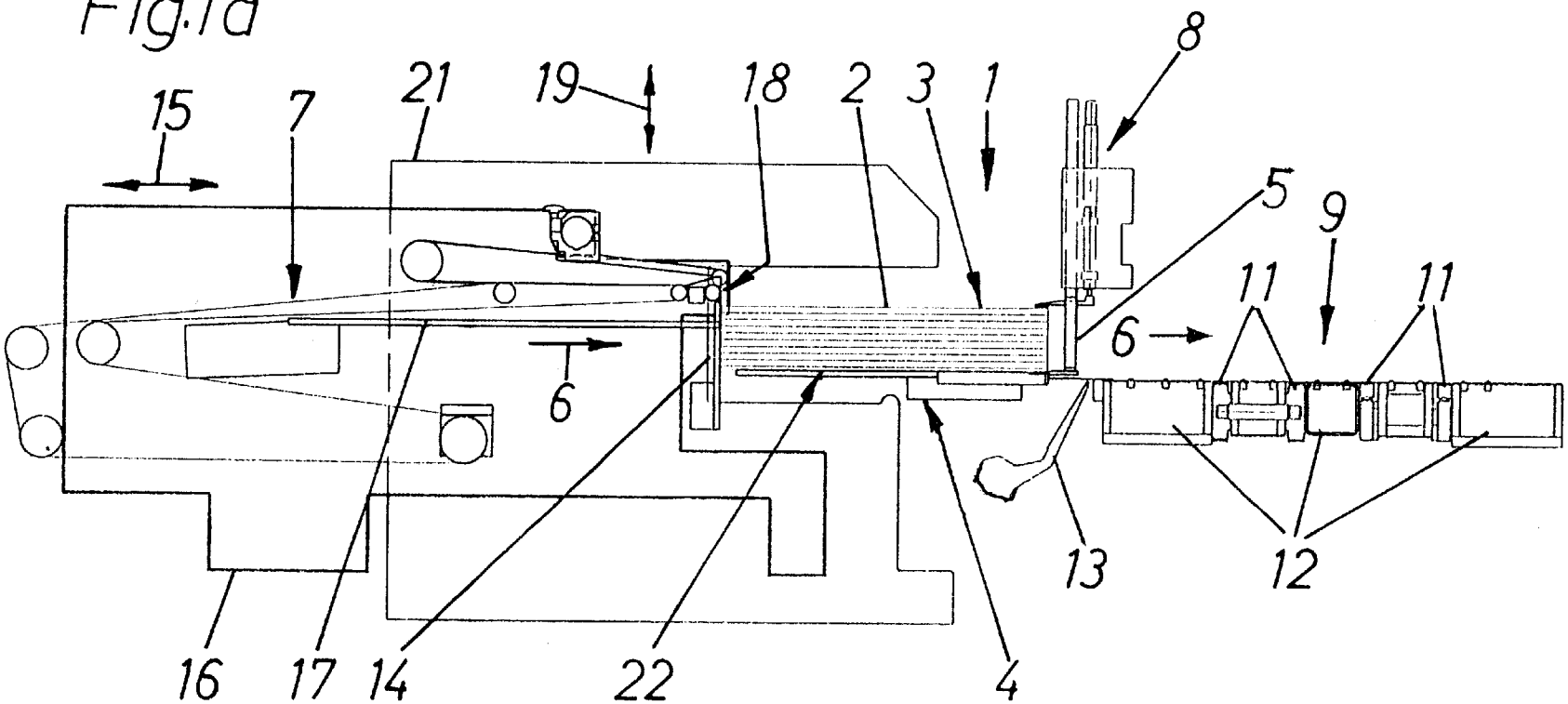
FIG. 1*a* is a schematic elevational view of an apparatus which embodies one form of the invention, a fully grown stack of overlapping sheets being about to be transferred from the stacking station onto an evacuating conveyor.

The apparatus which is shown in FIG. 1*a* comprises a stack collecting receptacle 4 which is located at a stacking station 1 and receives successive sheets 2 of a scalloped stream of (partially overlapping) sheets to gather a series of successive stacks 3 of overlapping sheets. As a rule, or at least in many instances, the improved apparatus comprises a battery of two or more receptacles 4 each of which receives successive sheets of a discrete scalloped stream of sheets 2, i.e., each of which gathers a discrete series of stacks 3. The receptacles 4 are located one behind the other, as viewed in FIG. 1*a*.

The sheets 2 of the stream shown in FIG. 1*a* are conveyed by a belt or band conveyor 7 which is operated to advance the partially overlapping sheets in the direction of the arrow 6. The receptacle 4 of FIG. 1*a* is followed by a stack withdrawing or removing unit 8 including grippers or tongs 5, and the tongs 5 are followed by an evacuating conveyor 9. The latter is designed to transport the (withdrawn) stacks 3 sideways, i.e., at right angles to the plane of FIG. 1*a*. In this embodiment, the conveyor 9 comprises stack-advancing endless belts 11 with integrated pneumatic table segments 12.

The sheets 2 of the growing stack 3 in the receptacle 4 are bounded by a front or downstream abutment or stop 13 and a rear or upstream abutment or stop 14 (as seen in the direction of the arrow 6). The front abutment is pivotable between an operative position (see FIG. 1*b*), in which it is located in front of and at a level above the growing stack of sheets 2 in the receptacle 4, and an inoperative or retracted position (FIG. 1*a*) at a level beneath the bottom part of the receptacle.

The rear abutment or stop 14 can comprise several sections (the same holds true for the abutment 13) and is mounted on a slide or carriage 16 which is movable in directions indicated by a double-headed arrow 15. The carriage 16 further supports the conveyor 7 as well as a rake-like platform 17 which serves as a separator and is movable with and also relative to the carriage 16. The platform 17 can perform (relative to the carriage 16) strokes of variable length.

The discharge or downstream end 18 of the conveyor 7 is located at a fixed distance from the platform 17. The carriage 16 is mounted on and is movable relative to a support 21 which can be said to constitute an elevator because it is movable up and down in directions indicated by a double-headed arrow 19.

Figure 3:
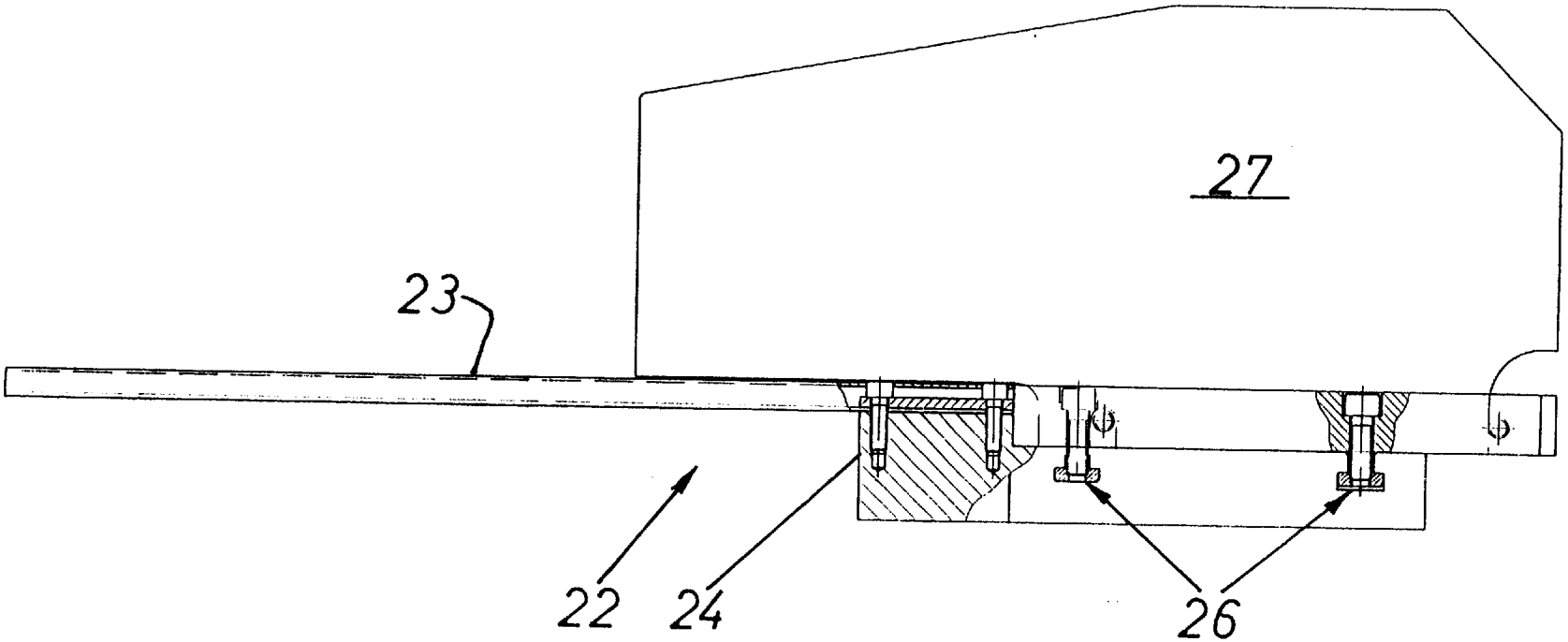
FIG. 3 is an enlarged fragmentary partly sectional view of a detail in the apparatus of FIGS. 1*a* to 1*d*.
Figure 4:
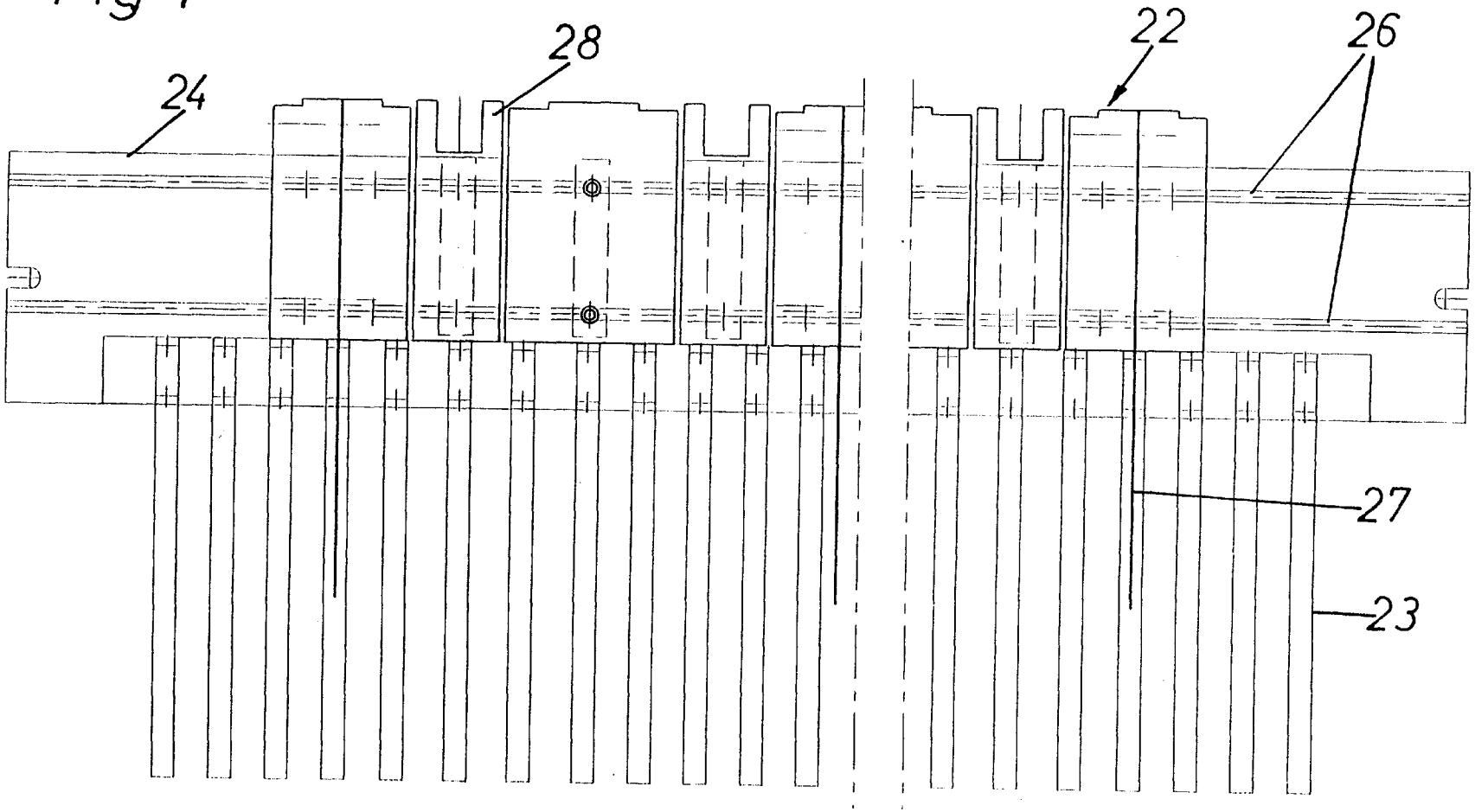
FIG. 4 is a plan view of the detail shown in FIG. 3.

The receptacle 4 comprises a bottom wall or panel 22 which includes a plurality of parallel supporting rakes 23 secured to a strip-shaped holder 24 (see FIGS. 3 and 4). The holder 24 is provided with transversely extending guides 26 for lateral stops 27 which can be fixed in selected guides 26, in dependency upon the format (size) of the sheets 2 and stacks 3, by distancing members.

Several bottom panels 22 can be assembled with suitable lateral stops 27 into preassembled groups or modules which are held in positions of readiness for eventual use in a manner and for purposes as will be described hereinafter.

The mode of operation is as follows:

FIG. 1*a* shows a fully assembled pile or stack 3 consisting of a predetermined number of sheets 2 being confined in the receptacle 4. The front abutment 13 (or the illustrated one of two or more front abutments) is already pivoted to its inoperative position, and the gripper or tongs 5 of the illustrated withdrawing unit 8 is ready to advance the freshly assembled stack 3 in the direction of the arrow 6, namely onto the evacuating conveyor 9. The latter is designed to advance the thus received stack 3 in a direction toward or away from the observer of FIG. 1*b*.

Figure 1B:
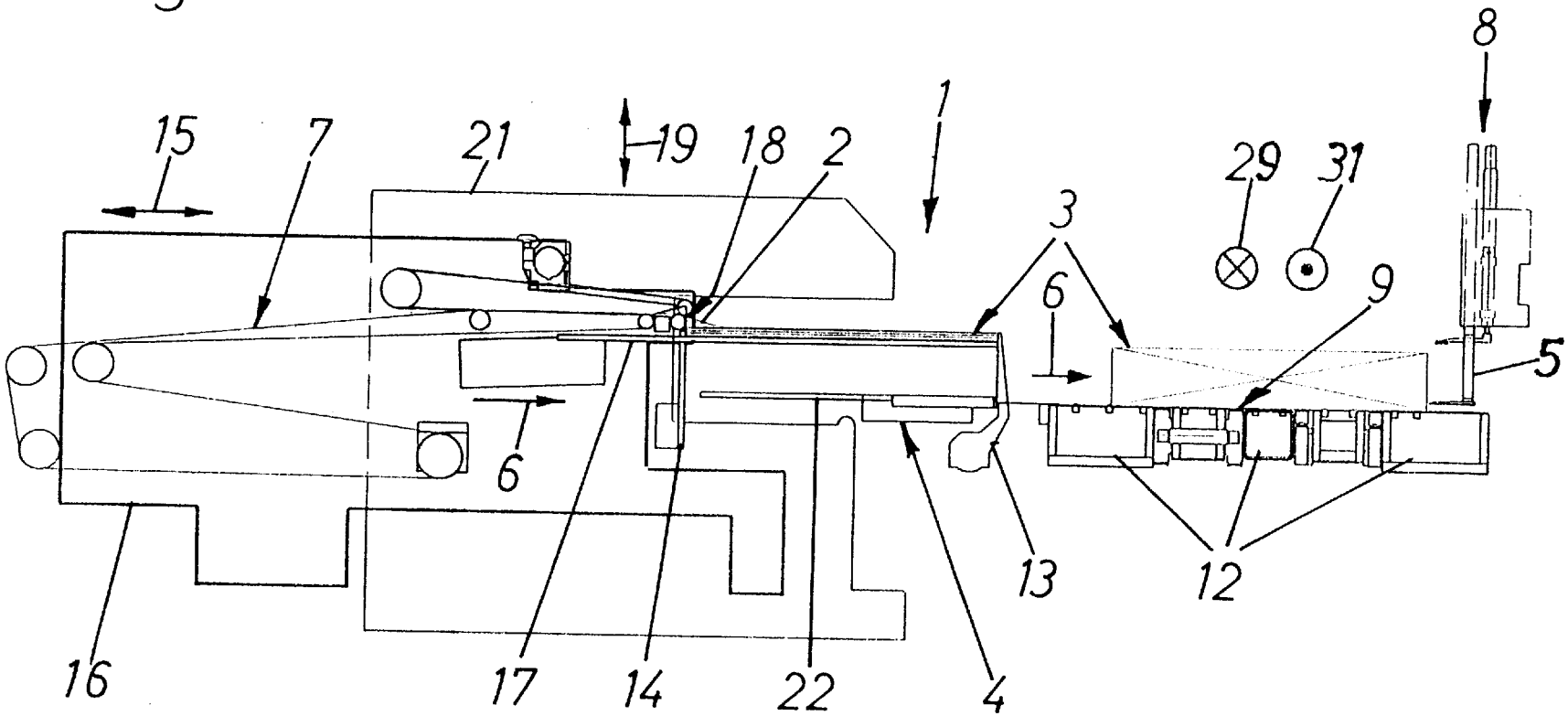
FIG. 1*b* shows the apparatus of FIG. 1*a* but in the process of gathering a next-following stack of sheets at the stacking station.
Figure 1C:
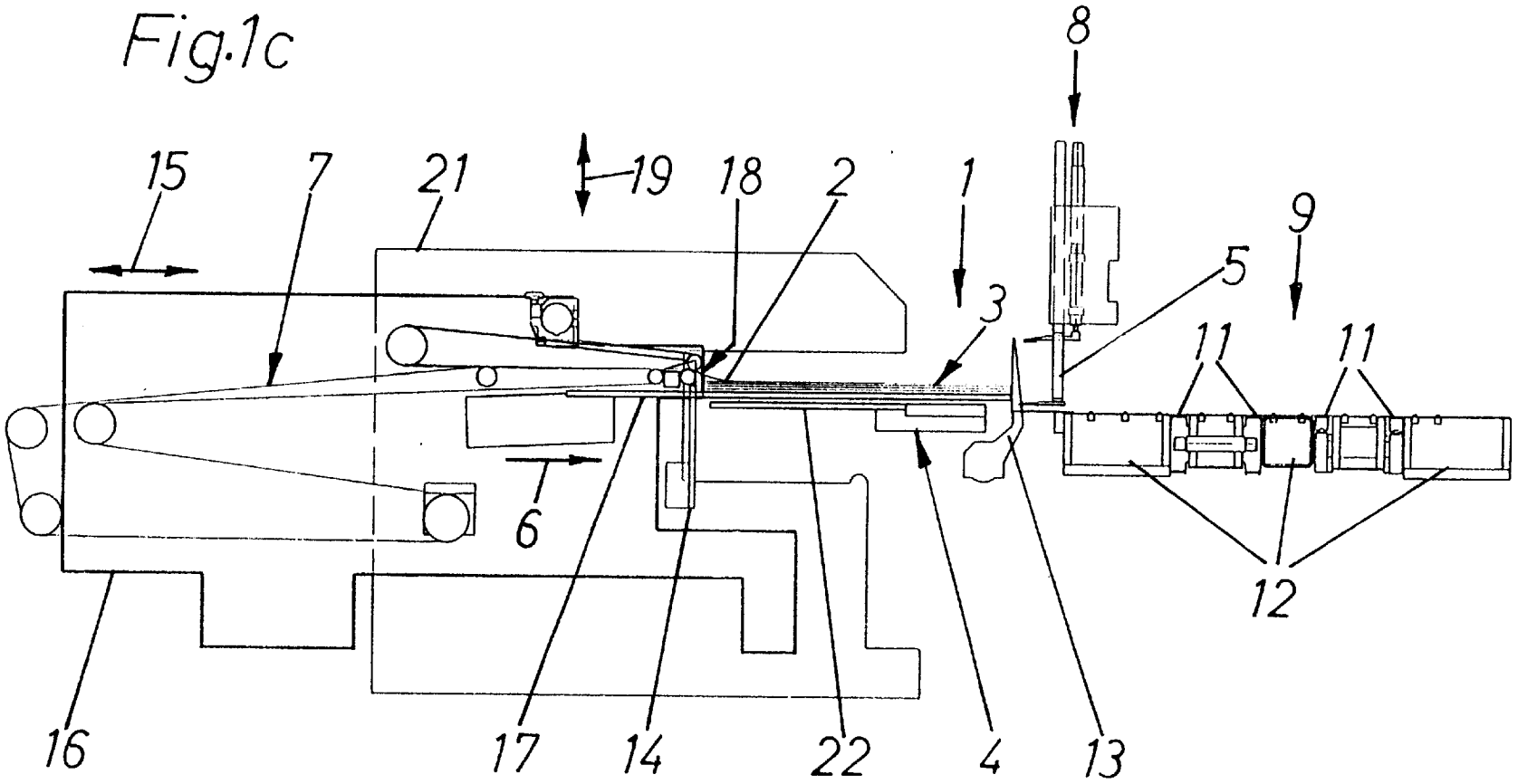
FIG. 1*c* shows the structure of FIG. 1*a* during a further stage of gathering the next-following stack at the stacking station and with the stack withdrawing unit retracted from the position of FIG. 1*b* back to the front stop at the stacking station.

The illustrated gripper 5 of the withdrawing unit 8 operates in synchronism with the platform 17 which comprises the aforementioned supporting rake and shares the forward movement of the fully assembled stack 3 in the direction of the arrow 6. FIG. 1*b* shows a fully assembled stack 3 on the conveyor 9 and the next-following (growing) stack 3 in the process of growing on top of the platform 17. Thus, the delivery of sheets 2 by the conveyor 7 need not be interrupted while the trailing abutment 14 establishes a path for advancement of successive sheets 2 of the scalloped stream of sheets toward and against the front abutment 13 which (see FIGS. 1*b* and 1*c*) is again in the operative position in which it intercepts the oncoming sheets 2.

Figure 1D:
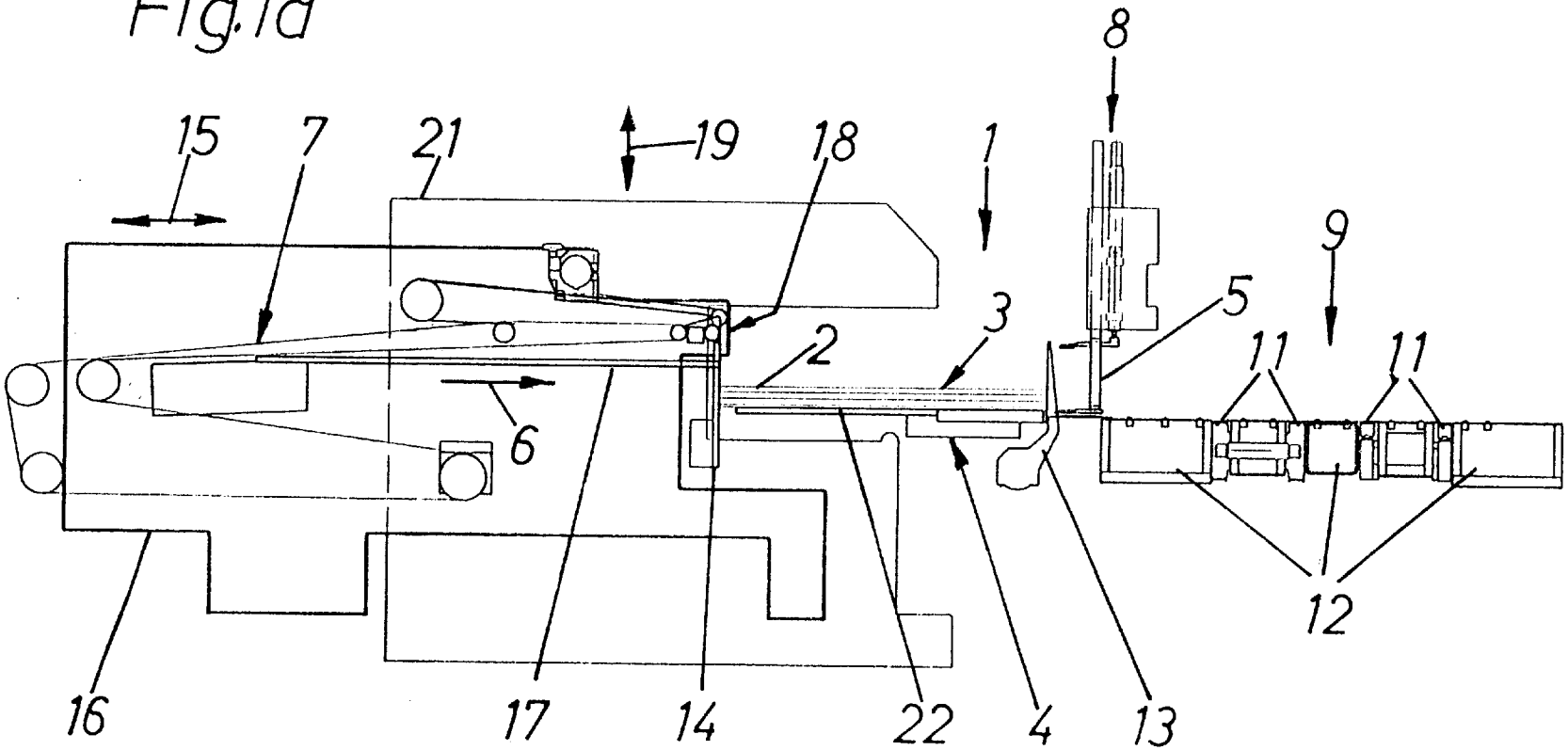
FIG. 1*d* shows the structure of FIG. 1*c* but with the rear stop in a raised position.

The support or elevator 21 descends, as indicated by the lower half of the arrow 19 (FIG. 1*c*) , to lower the platform 17 so that it reaches or descends even below the level of the panel 22, and is thereupon retracted to the position shown in FIG. 1*d*. Such manipulation of the elevator 21 results in the deposition of the growing stack 3 of sheets 2 on the panel 22 of the receptacle 4.

The next step involves an upward movement of the elevator 21 (as indicated by the upper half of the arrow 19);

this entails a lifting of the discharge end 18 of the conveyor 7 to a level such that it rises at the rate at which the height of the growing stack 3 on the platform 22 increases. Such mode of operation is desirable and advantageous because each sheet 2 of successively delivered sheets supplied by the conveyor 7 descends through the same distance. This contributes to uniformity of the successively accumulated stacks 3.

Figure 2A:
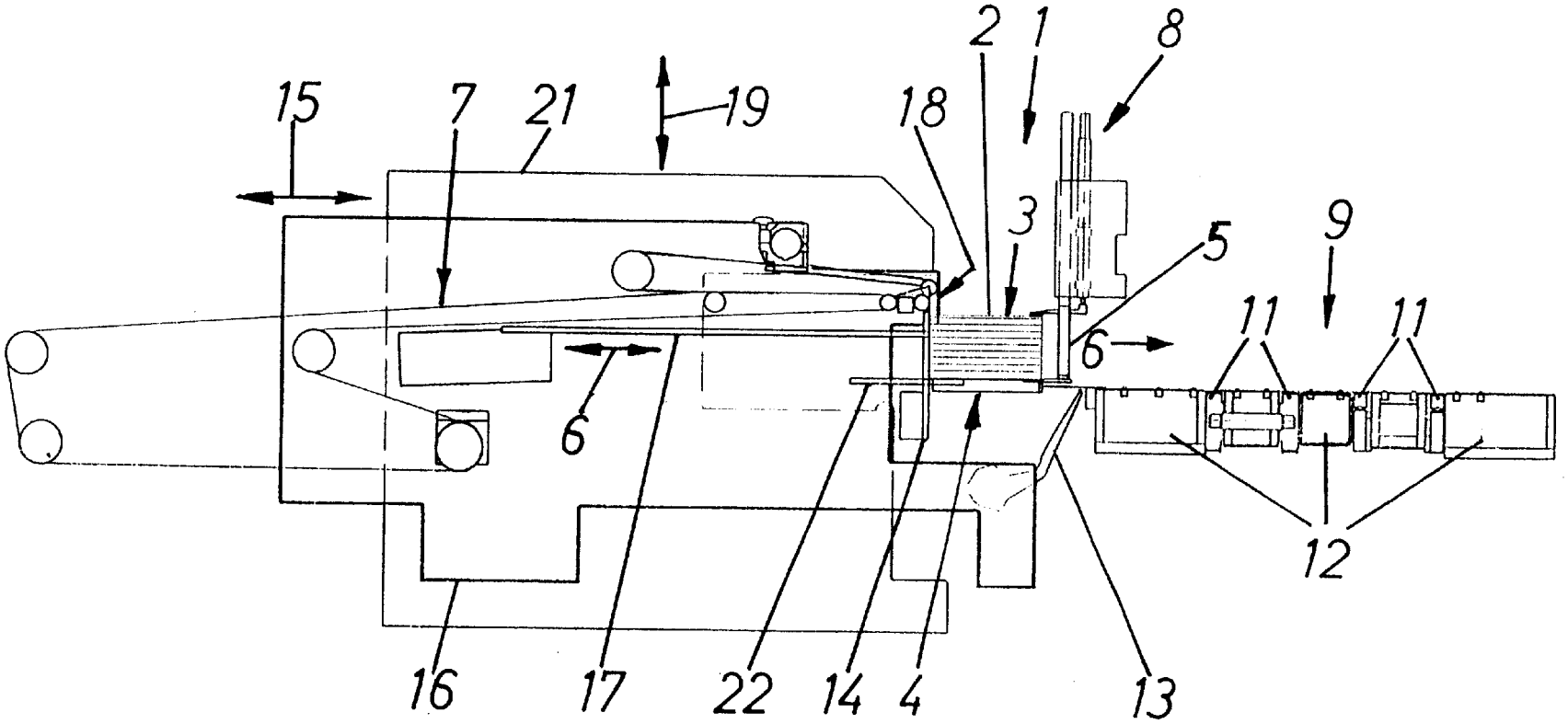
FIG. 2*a* shows the apparatus of FIG. 1*a* but in the course of gathering a stack of sheets shorter than those shown in FIGS. 1*a* to 1*d;*
Figure 2B:
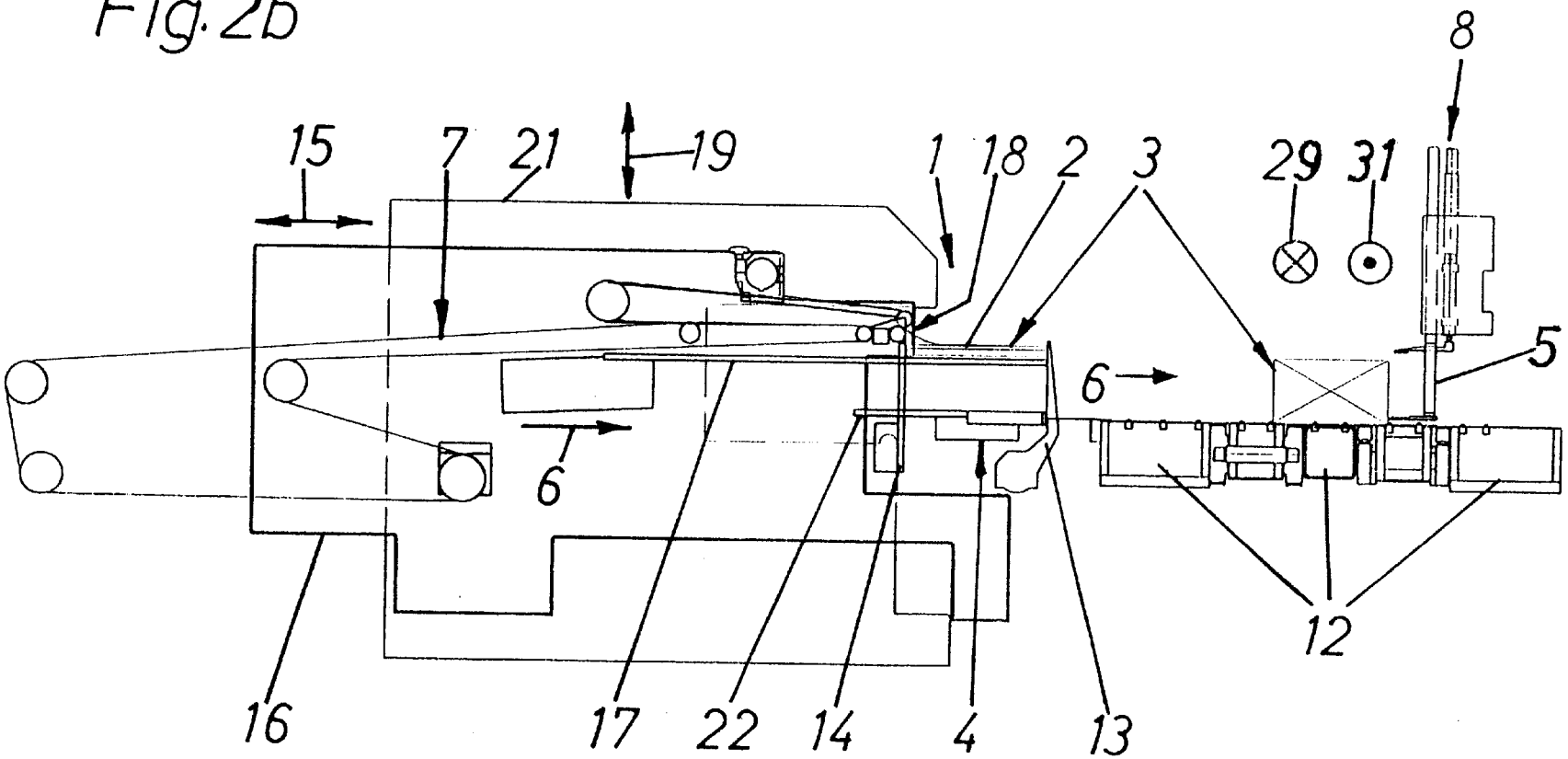
FIG. 2*b* shows the apparatus of FIG. 2*a* but during gathering of a next following stack of shorter sheets.

FIGS. 2*a* and 2*b* illustrate the manner in which the improved apparatus can be adjusted to permit for the accumulation of stacks of sheets smaller or larger than the sheets 2 shown in FIGS. 1*a* to 1*d*. The carriage 16 is moved in one of the directions indicated by the double-headed arrow 15, and this results in identical movements of the rear abutment 14 as well as of the discharge end 18 of the conveyor 7 and of the platform 17. Thus, the distance between the abutments 13 and 14 is reduced accordingly (it is assumed here that the carriage 16 has been moved in a direction to the right, as viewed in FIG. 1*a*).

If one desires to change the effective width of the receptacle 4, i.e., to stack narrower or wider sheets, it is merely necessary to replace the aforementioned module 22, 27 with a different module.

The extent of movement of the platform 17 in or counter to the direction indicated by the arrow 6 is changed as a function of change of the distance between the front and rear abutments 13 and 14. The length of the forward stroke of the gripper 5 remains unchanged due to the absence of any appreciable changes of the forward stroke of the stack removing unit 8. In fact, the length of the forward stroke is reduced if the format (size) of the sheets 2 is reduced.

An important advantage of the improved apparatus is that the just discussed changes of the format of the stacks 3 can be carried out in a simple and time-saving manner. This is accomplished by the provision (a) of the carriage 16 which supports the platform 17 and the rear or upstream abutment 14, and (b) of the means for moving the carriage 16 up and down (arrow 19) as well as forwardly and backwards (arrow 15). Furthermore, the carriage 16 supports the conveyor 7 at a fixed distance from and above the platform 17.

Another advantage of the improved apparatus is that the aforedescribed changes of the format can be carried out without necessitating any changes in the position and/or movements of the front or downstream abutment(s) 13. This, in turn, ensures that the stroke or strokes of the gripper or grippers 5 can remain unchanged.

A further important advantage of the improved apparatus is that the discharge end 18 of the sheet supplying conveyor 7 and the platform 17 share the movements in directions indicated by the double-headed arrow 19; this ensures that the extent of descent of successive sheets 2 from the conveyor 7 into the receptacle 4 is the same while a stack 3 is in the process of growing in the receptacle as well as during withdrawal of a fully grown stack from the receptacle (while the conveyor continues to deliver sheets toward and beyond the discharge end 18).

An additional important advantage of the improved apparatus is that the carriage 16 (which is movable in directions indicated by the double-headed arrow 15) carries the conveyor 7, the rear abutment 14 and the platform 17. This renders it possible to complete any required adjustments within a surprisingly short interval of time, i.e., the parts 7, 16 and 17 can be adjusted as a unit.

Additional savings in time and space are achieved by the provision of the elevator 21 which is movable up and down (arrow 19) and supports the carriage 16 in such a way that the latter is movable in directions indicated by the arrow 15. Such practically universal movability of the carriage 16 with and relative to the elevator 21 contributes to simplicity and predictability of stacking of sheets in the receptacle 4 as well as to rapid conversion of the apparatus for the stacking of larger, smaller, narrower or wider sheets. The movements of the platform 17 in dependency on the selected format of stacks 3 can be simplified and rendered more precise by selecting the extent of movements of the platform in directions indicated by the arrow 15 to conform to the selected distance between the front and rear abutments 13 and 14.

The features which are illustrated in and which were described with reference to FIGS. 3 and 4 contribute to a simplification of adjustments which are to be carried out when the conveyor 7 is to deliver narrower sheets 2 following the delivery of a series of wider sheets or vice versa.

An advantage of the feature that the mounting of the front abutment 13 can remain unchanged when the length of the sheets 2 is changed from shorter to longer or vice versa is that the strokes which are being performed by the grippers 5 can remain unchanged. This simplifies the design of the stack withdrawing unit 8 as well as of the evacuating conveyor 9.

To summarize: The improved apparatus renders it possible to simplify the conversion from the stacking of sheets having a first format to the stacking of sheets having a different second format and to enable the persons in charge to complete the conversion within a surprisingly short interval of time. Furthermore, the components which render such conversion possible are simple, compact and inexpensive.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for accumulating and transporting stacks of paper sheets and the like and, therefore, such aaptations should and are intended to be comprehended within the meaning and range of equivalence of the appended claims.

What is claimed is:

1. Apparatus for gathering successive sheets of a series of sheets into growing stacks and for removing fully grown stacks from a receptacle at a stacking station, comprising:

means for conveying successive sheets of the series of sheets in a first direction into the receptacle to thus accumulate in the receptacle a growing stack of overlying sheets;

front and rear abutments for the sheets of a stack in said receptacle, said abutments being spaced apart from each other in said first direction and said front abutment being movable relative to said receptacle between operative and inoperative positions, wherein said conveying means is arranged to deliver to said receptacle sheets having different lengths and said rear abutment is adjustable to conform the spacing of said abutments from each other to the lengths of sheets being conveyed to said receptacle;

means for withdrawing fully grown stacks from the receptacle in said first direction when said front abutment is in the inoperative position;

means for transporting withdrawn stacks in a second direction, wherein the second direction is different from the first direction; and means for adjusting said rear abutment in and counter to said first direction.

2. The apparatus of claim 1, wherein said receptacle comprises an exchangeable bottom wall.

3. The apparatus of claim 2, wherein said bottom wall includes an exchangeable substantially strip-shaped holder and a plurality of supporting rakes carried by said holder.

4. The apparatus of claim 3, further comprising lateral stops and guide means for said stops provided on said holder.

5. The apparatus of claim 1, further comprising a platform for receiving sheets from said conveying means, wherein said platform is adjacent to said conveying means, and is movable between a plurality of different positions.

6. The apparatus of claim 5, wherein said platform is movable relative to said stacking station in and counter to said first direction in synchronism with said withdrawing means.

7. The apparatus of claim 5, wherein said means for conveying moves up and down with said platform between a plurality of different levels.

8. The apparatus of claim 5, wherein said means for conveying has a forward end disposed at a predetermined distance from said platform.

9. The apparatus of claim 5, further comprising:

a carriage for supporting said platform and for supporting said conveying means; and an elevator for moving said carriage between a plurality of different levels.

10. The apparatus of claim 9, wherein said carriage is movable in and counter to said first direction.

11. The apparatus of claim 9, wherein said platform is movable relative to said carriage in and counter to said first direction through distances corresponding to the extent of adjustment of said rear abutment relative to said front abutment.

12. The apparatus of claim 9, wherein said carriage is movable in and counter to said first direction relative to said elevator.

13. The apparatus of claim 12, wherein said elevator is movable up and down relative to said receptacle.

* * * * *